US005181679A

United States Patent [19]

Frielinghaus et al.

[11] Patent Number: 5,181,679

[45] Date of Patent: Jan. 26, 1993

[54] RAILWAY TRAIN SPEED RESTRICTION APPARATUS

[75] Inventors: Klaus Frielinghaus; Steven M. Ferrarese, both of Rochester, N.Y.

[73] Assignee: General Railway Signal Corporation, Rochester, N.Y.

[21] Appl. No.: 748,576

[22] Filed: Aug. 22, 1991

[51] Int. Cl.[5] ..... B61L 3/08

[52] U.S. Cl. ..... 246/182 R; 246/187 R; 273/435

[58] Field of Search ..... 246/28 R, 28 D, 34 R, 246/34 B, 167 R, 167 A, 178, 182 R, 187 R, 187 A, 187 B; 273/435

[56] References Cited

U.S. PATENT DOCUMENTS

| | | | |
|---|---|---|---|
| 3,072,785 | 1/1963 | Hailes | 246/187 R X |
| 3,500,388 | 3/1970 | Marsh et al. | 246/182 R X |
| 3,525,044 | 8/1970 | Richmond | 246/182 R |
| 3,927,851 | 12/1975 | Wilcox | 246/37 |
| 4,217,643 | 8/1980 | Anderson et al. | 246/187 R X |
| 4,234,922 | 11/1980 | Wilde et al. | 246/182 R X |
| 4,279,395 | 7/1981 | Boggio et al. | 246/182 R |
| 4,307,463 | 12/1981 | Sibley | 246/5 X |
| 4,732,355 | 3/1988 | Parker | 246/34 R |
| 5,006,989 | 4/1991 | Parker | 246/182 R X |

*Primary Examiner*—David A. Bucci
*Assistant Examiner*—Scott L. Lowe
*Attorney, Agent, or Firm*—M. Lukacher

[57] ABSTRACT

Apparatus for use in a train speed control system which meets speed control signals, known as code rate signals, into a track section and restricts the injection of other signals which would allow faster train speeds. The apparatus enables speeds to be restricted in sections of the track where maintenance crews are working or otherwise where necessary or desirable. The apparatus is adaptable for use with many different configurations of speed control signals as may be used by different rapid transit authorities. The apparatus has a speed restriction carrier printed circuit board which presents a first set of contacts along an edge thereof which may be at the end of a slot into which a speed restriction selection printed circuit board is insertable in a plurality of different positions (eight positions for a square board). The speed restriction selection board has a plurality of second sets of contacts, two sets sharing the same edge of the board. These second sets of contacts provide different combinations of connections between the first set of contacts thereby imposing selected speed restrictions on speed control signals which are carried by the speed restriction carrier board.

19 Claims, 13 Drawing Sheets

| RESTRICTION | IND. |
|---|---|
| NORM. 70 MPH | G |
| 55-35 MPH | Y/G |
| 25 MPH | Y |
| 15 MPH | R/Y |
| STOP | R |
| CUT-OUT | NONE |

RAILWAY TRAIN SPEED RESTRICTION APPARATUS

The present invention relates to railway signalling systems and particularly to railway signalling systems which provide signals for controlling the speed of the train in sections of the track, such speed control being provided by displaying signals in the cab of the train which are followed by the engineer or train driver or by automatic throttle/brake control.

The invention is especially suitable for use in train speed control systems wherein the speed control signal is transmitted to the train in the form of an audio frequency current injected into the track in a section of the track as is picked up by receivers carried on the train as the train enters the track section into which the signals are injected. The frequency may be one or a plurality of frequencies. They are conventionally an on-off modulation of a carrier signal which is injected into the track. The rate of modulation or "code rate" provides different speed commands. In general, the modulation rate spans a range of 1.25 Hz to 21.5 Hz. A typical rapid transit authority may have a highest speed code rate (code rate 1) of 10.8 Hz, indicating 70 MPH (miles per hour). In descending order, the code rates of 4.5, 3.8, 2.0 and 1.25 Hz represent in this case 55, 35, 25 and 15 MPH, respectively. The absence of a code rate may be used as a "stop command" code rate. A particular frequency (for example in the above railway authority 18.5 Hz) may be used as the "stop" code rate. Another code rate may be used as a "cut out" command. The "cut out" command is a special command indicating to the engineer or train driver and/or the automatic speed control system with which the train is equipped that the train is entering a track section that does not have speed control information being transmitted to it.

Such speed control systems are discussed in the following patents to which reference may be made for further information with respect thereto: J. W. Parker, U.S. Pat. No. 5,006,989 issued 4/9/91; H. C. Sibley, U.S. Pat. No. 4,307,463 issued Dec. 22, 1981; and J. W. Parker, U.S. Pat. No. 4,732,355 issued Mar. 22, 1988.

If there is work being done on the track or in close proximity to the track, it may be necessary or desirable to override the automatic train speed control system and prevent the injection into the track section of signals which would allow speeds above a safe speed for the temporary conduction on that section of track, even though track occupancy or other factors which govern the operation of the speed control system, might allow a higher speed. The lower speed transmitted to the train, would be a speed that is safe and in keeping with temporary conditions on the track. Accordingly, speed control systems have utilized manually operated speed restriction apparatus. Such apparatus may allow the automatic speed control system to continue to operate but restricts the speed information transmitted to the train to a maximum speed set by the speed restriction apparatus. It is desirable that this maximum speed limit be one of several values that are available to the train dispatcher or to maintenance crew personnel. It is also necessary that the speed restriction apparatus be vital (fail-safe) in operation since it affects the safety of the train and/or personnel that may be working on or near the track. Prior art speed restriction arrangements are discussed hereinafter in connection with FIGS. 1 and 2. Such arrangements have not been entirely satisfactory for various reasons including ease of operation, maintaining vital (fail-safe) operation, and lack of flexibility in being restricted for use in a particular railway authority (on a particular speed control system).

Accordingly, it is an object of the present invention to provide improved train speed restriction apparatus for limiting allowable train speeds in a section of track that is adapted for use by most transit authorities.

It is another object of the present invention to provide improved train speed restriction apparatus which is vital (fail-safe) in operating to limit allowable train speed in a track section where speed restrictions are necessary or desirable.

It is still another object of the invention to provide improved speed restriction apparatus which is compatible with and may be used with minor easily implemented modifications in train speed control systems which may have different complements of speed control signals (for example, different combinations of code rates or multiple carrier frequencies), thereby reducing the overall cost of the train speed control system.

It is a further object of the invention to provide improved train speed restriction apparatus having a single element for setting up restrictions at different speeds and which can be implemented as a plug-in selector board which is square in configuration and has four edges and two sides and is receivable in a carrier board which carries the speed restriction signals in eight different positions, each corresponding to a different speed restriction.

It is a still further object of the present invention to provide improved speed restriction apparatus wherein different combinations of connections depending upon the desired speed restriction are set up using a single selector element having contacts providing one set of the connections and wherein vital operation is obtained by interlacing a ground or common protection circuit between each path carrying vital speed control speed signals, thus providing protection against short circuits between adjacent vital circuit paths, due to creepage or other shorting means. Furthermore, the presence of this vital protective interlaced "ground" circuit is detected by it shutting down the Code Rate Generator output, if this protective interlaced grounding path becomes an open circuit or becomes detached from ground.

It is a more specific object of the invention to provide improved train speed restriction apparatus forming an interface between components which generate code rate signals and components which use a code rate signal to generate and inject speed control signals into the track so as to prevent the injection of speed control signals greater than as may be selected by cognizant personnel such as the dispatcher or maintenance personnel as may be in keeping with safety for temporary conditions for that track section notwithstanding that speed control signals corresponding to higher speeds are commanded by the cab signalling or speed control system from track occupancy conditions or preprogrammed speed limits, and particularly as interface using a single plug-in connector element having multiple positions of connection and which is capable of being set up in a position corresponding to the maximum allowed speed to which restriction is desired, and which apparatus is vital in operation and universal in applicability to systems having different complements and arrangements of speed control signals.

Briefly described, the apparatus for restricting injection of control signals corresponding to allowed train speeds in a railroad train speed control system embodying the invention, provides connector means between a source providing a plurality of control signals and means responsive to the control signals from the source for generating and injecting an appropriate control signal into the tracks at the track section where train speed is controlled. The connector has a first member, which may be a speed restriction carrier board carrying the speed control signals or signals which are operative to generate them. The speed restriction carrier board has a receptacle for a removable and selectively positionable selector board. The selector board has a plurality of sets of contacts each corresponding to a different allowed reduced speed. When, in a selected position with the contacts of the selector board making contact with the contacts of the carrier board, a combination of connections is made which enables only the generation and injection of speed control signals corresponding to speeds at or below the allowed speed. A vital structure is provided by the use of contacts on the selector board and the carrier board and connections on these boards between these contacts which provides a series circuit interlaced between the circuits which carry the speed control signals or signals operative to cause the generation of the speed control signals. Any conductive creepage between these vital circuits or any failure to make connections provides open circuit conditions which are used to inhibit the generation of the speed control signals; the absence of a speed control signal being a safe condition dictating a minimal speed or stop for the train in the section being controlled. Contacts on the selector and carrier board also provide connections to an indicator array, suitable of lamps of different color, different combinations of which corresponding to the allowable (restricted) speed condition.

The foregoing and other objects, features and advantages of the invention as well as a presently preferred embodiment thereof, will become apparent from a reading of the following description in connection with the accompanying drawings in which.

Figure 3A:
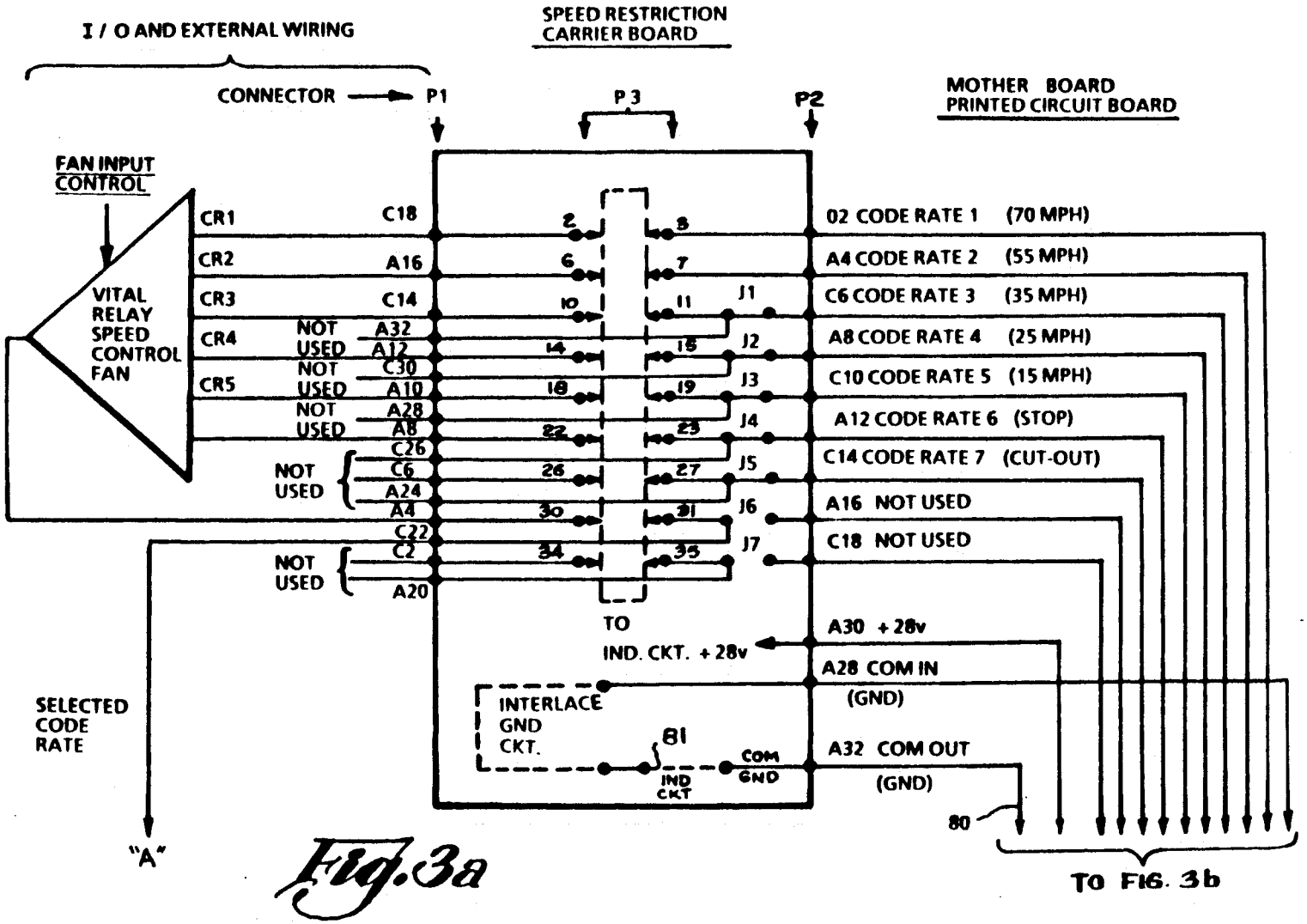
Figure 3B:
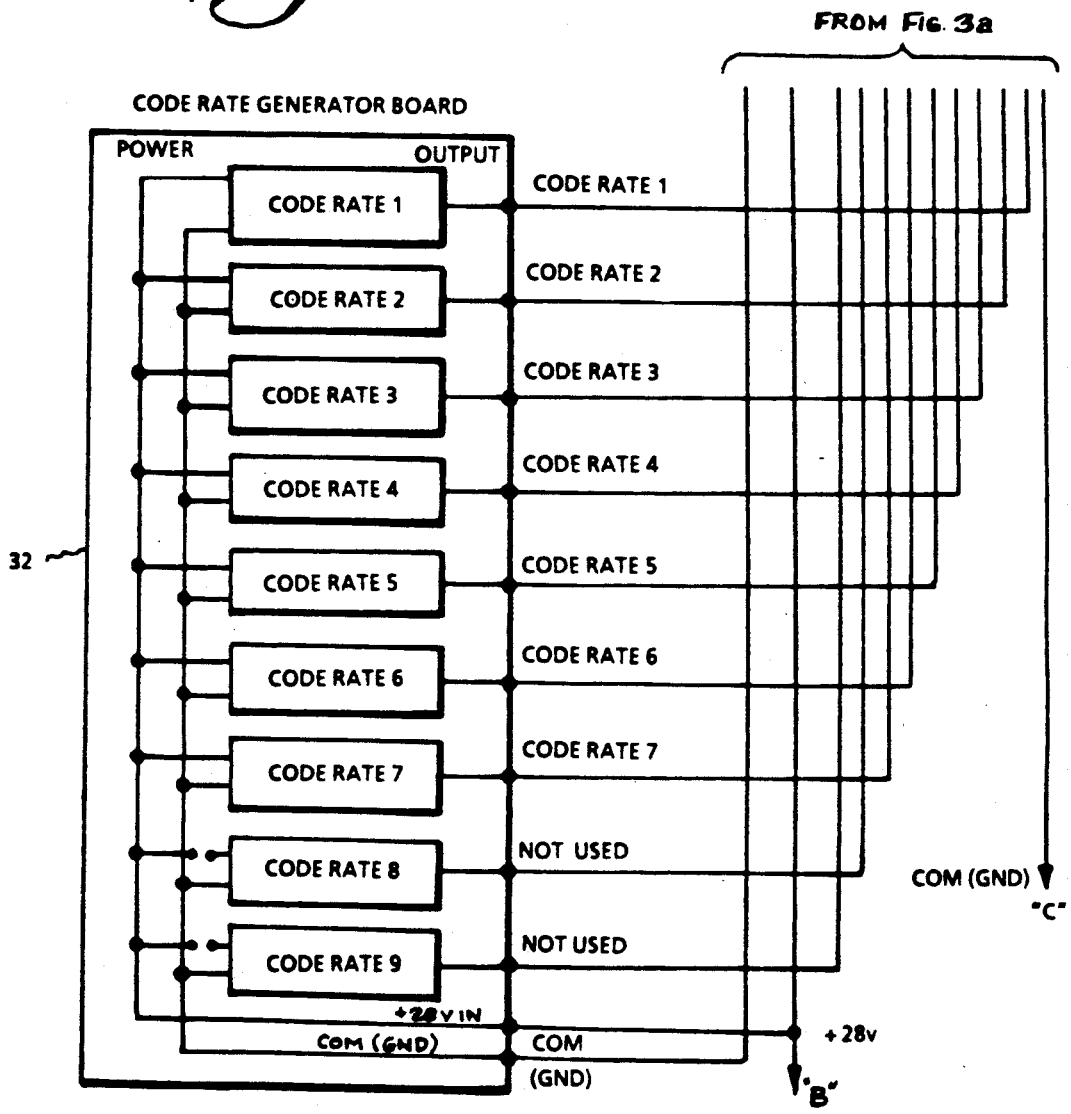
Figure 3C:
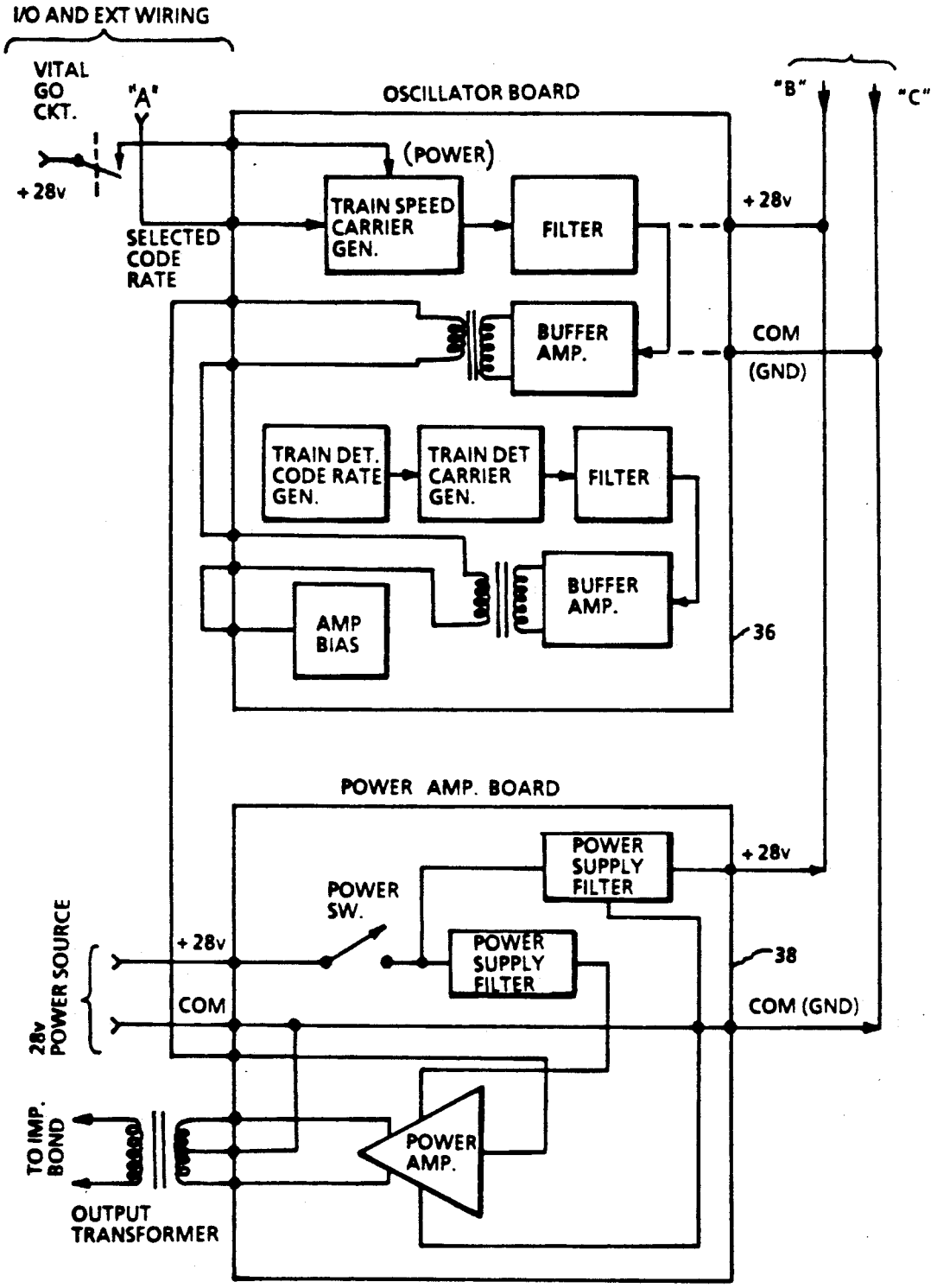
Figure 4:
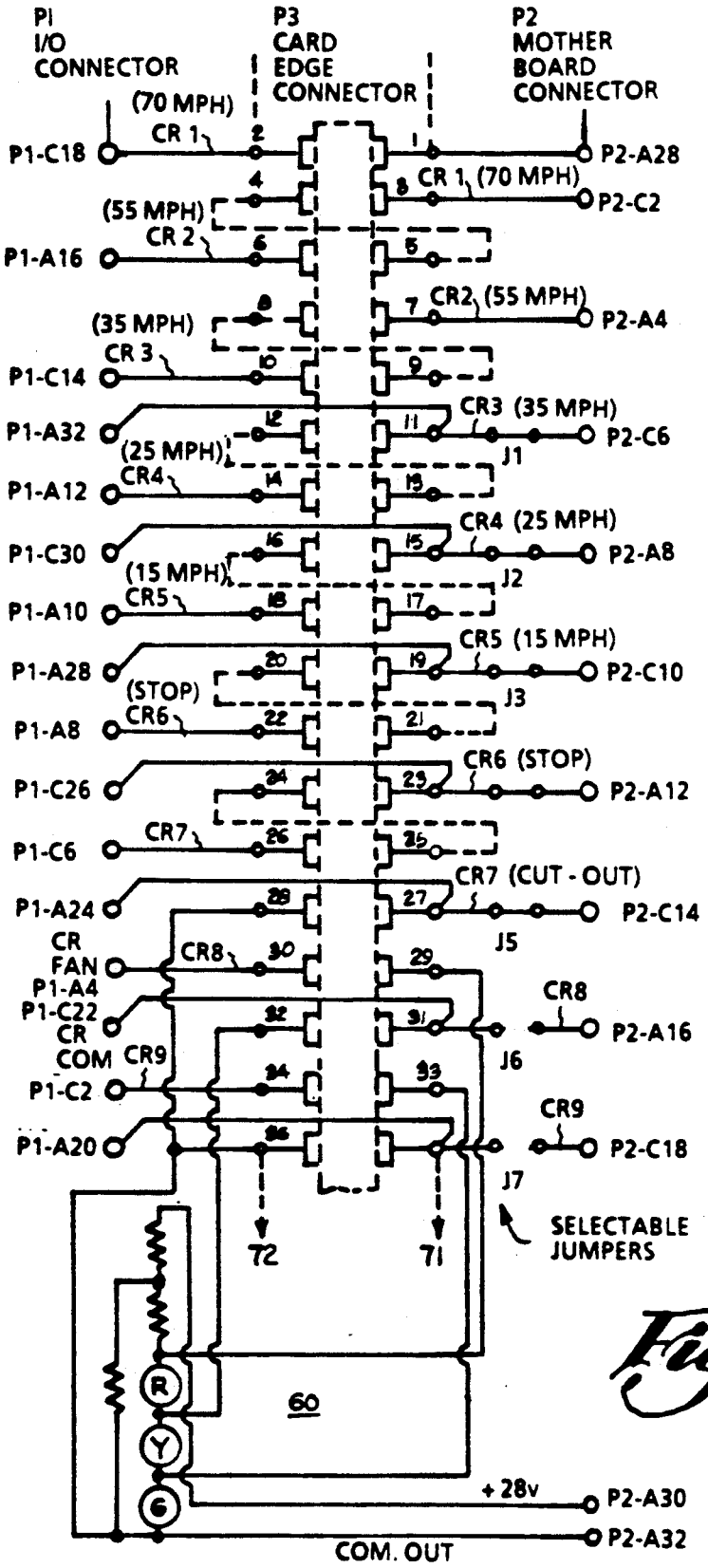
Figure 5:
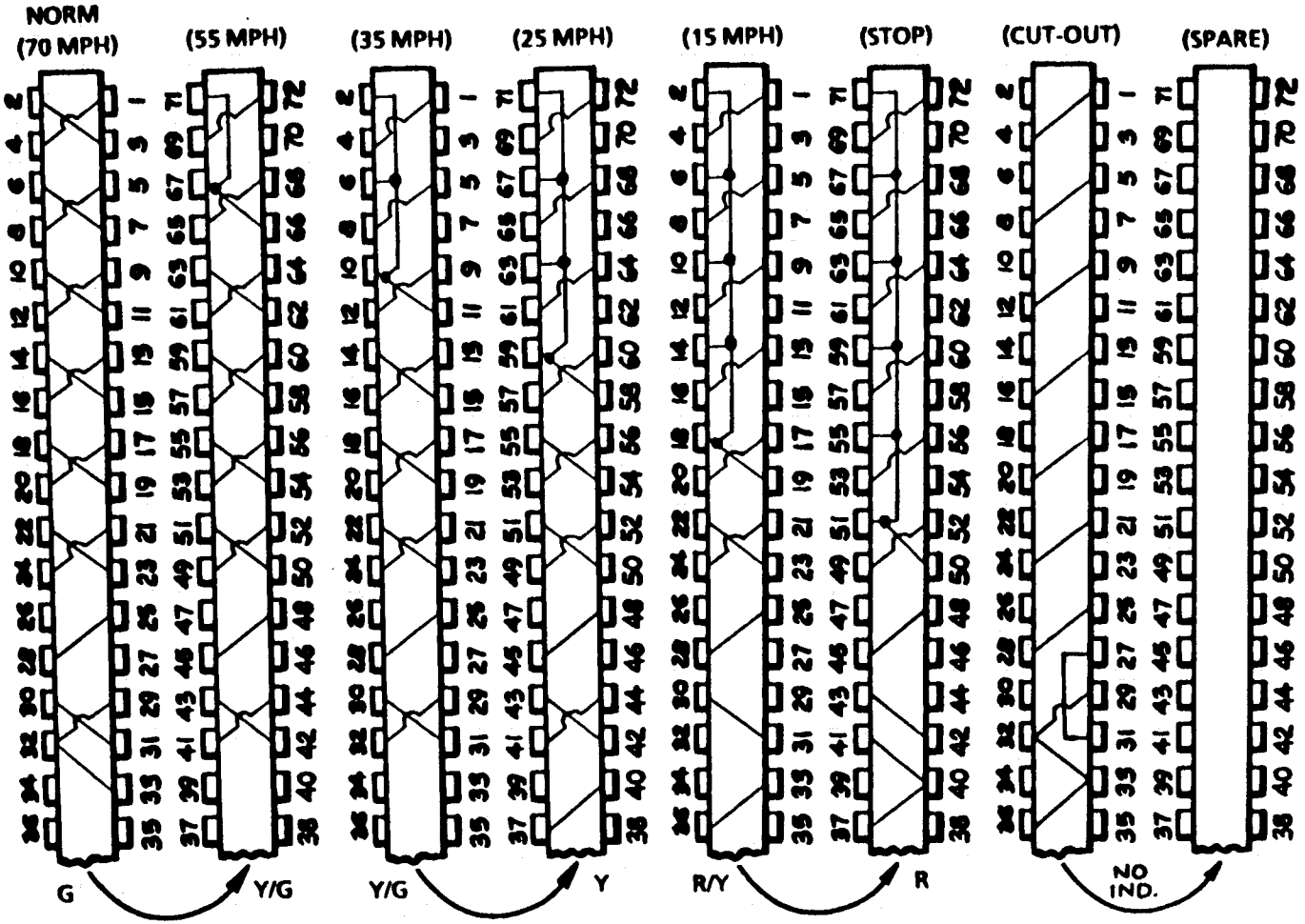
Figures 6, 7:
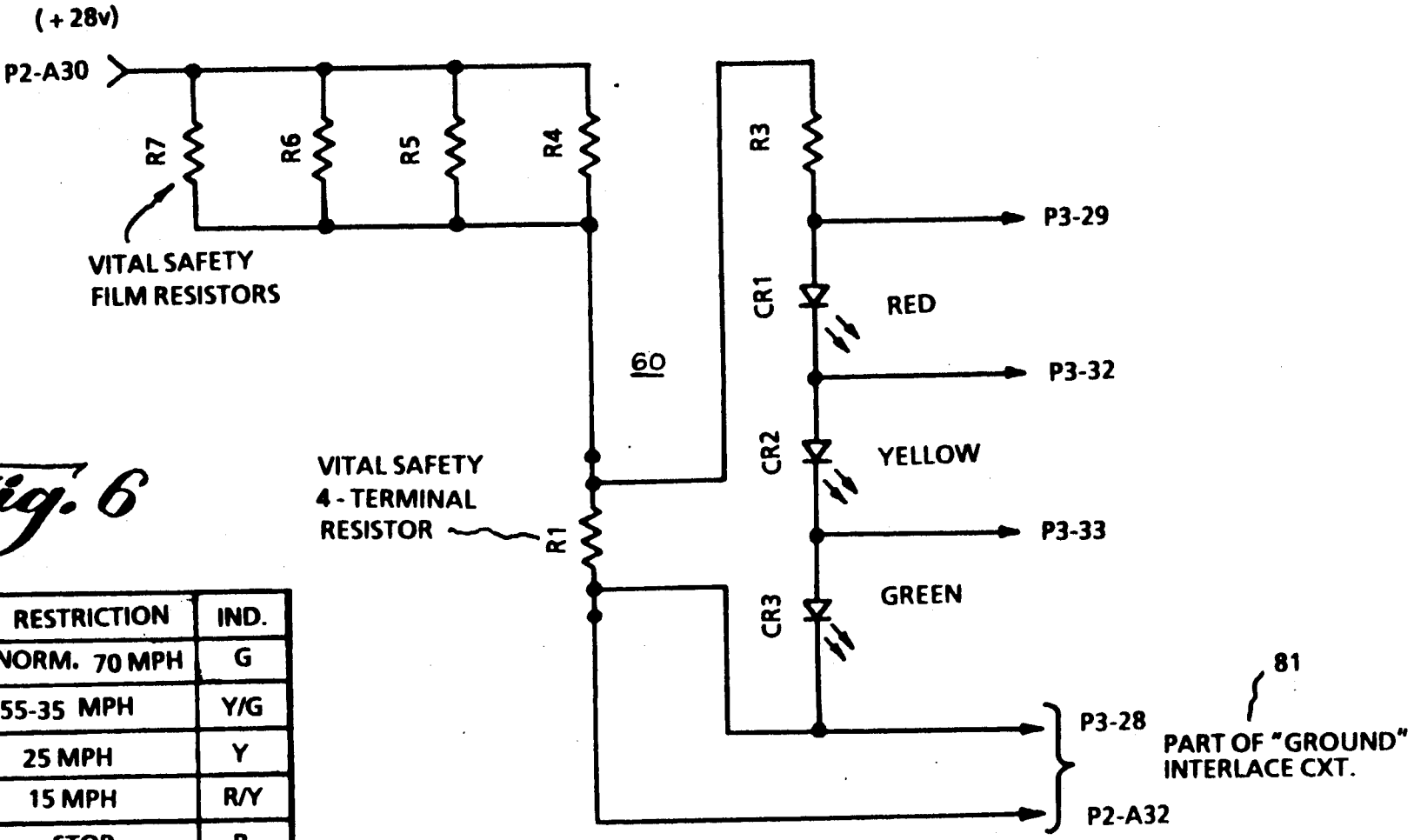
Figure 8:
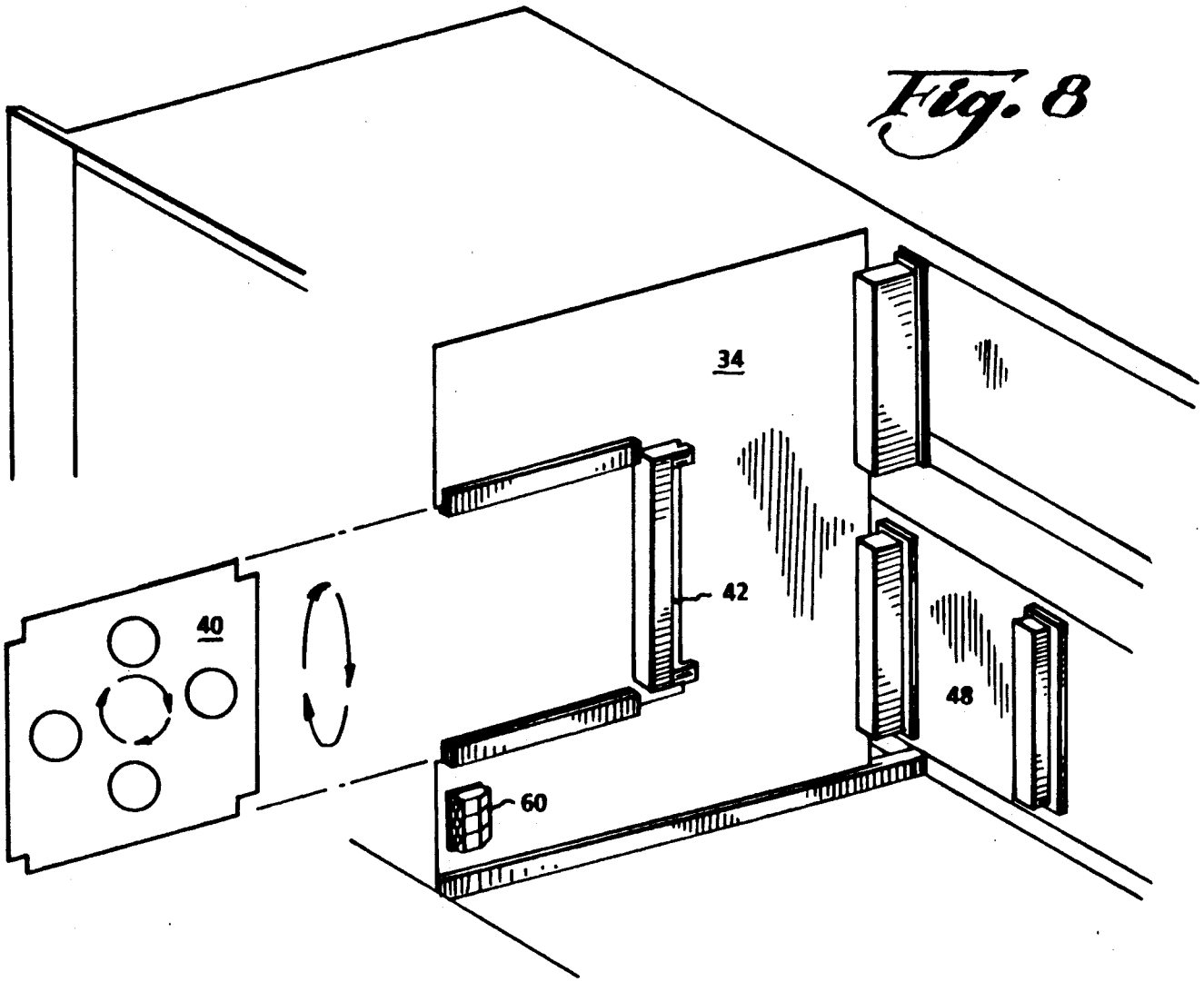
Figure 9:
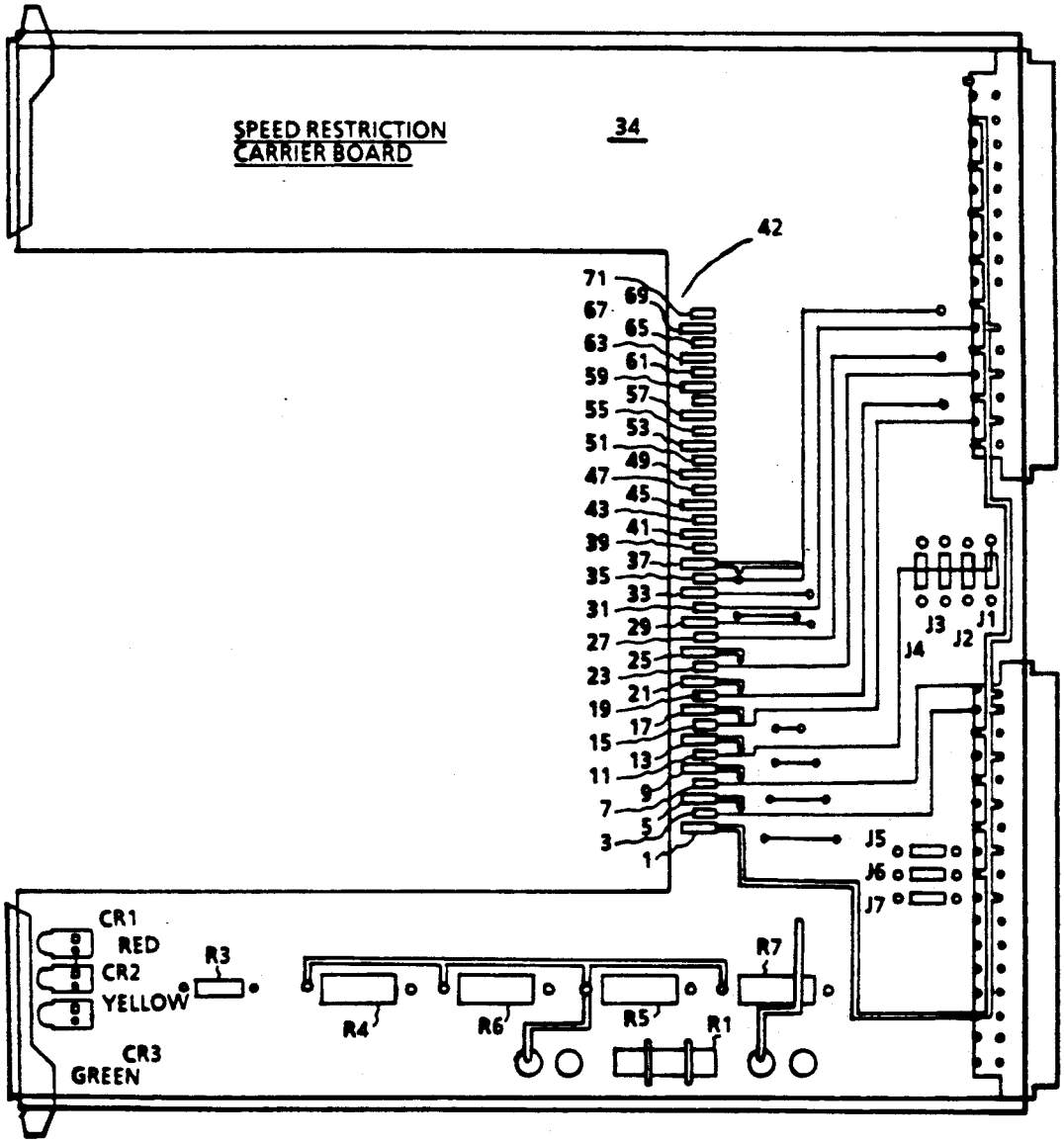
Figure 10:
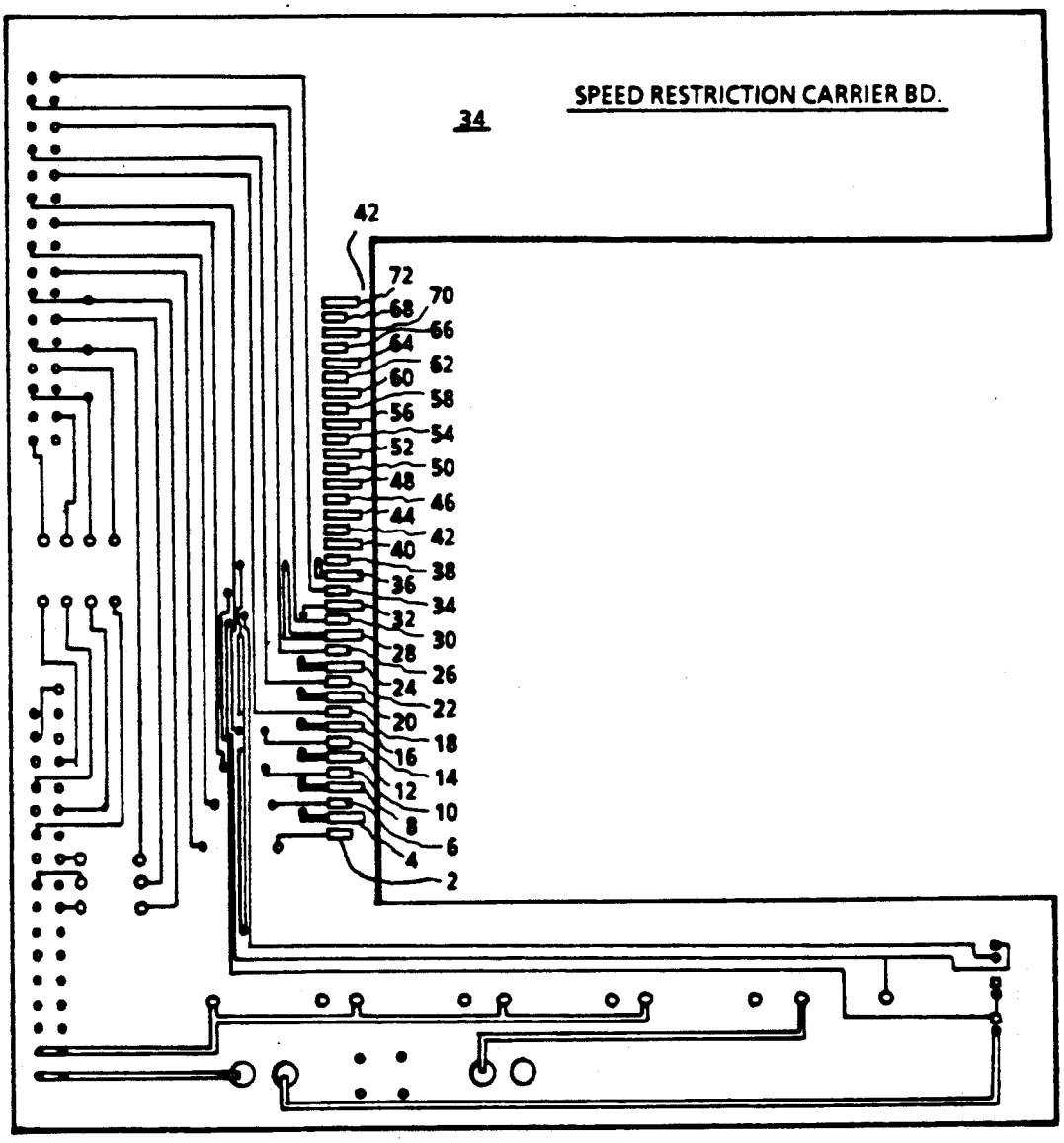
Figure 11:
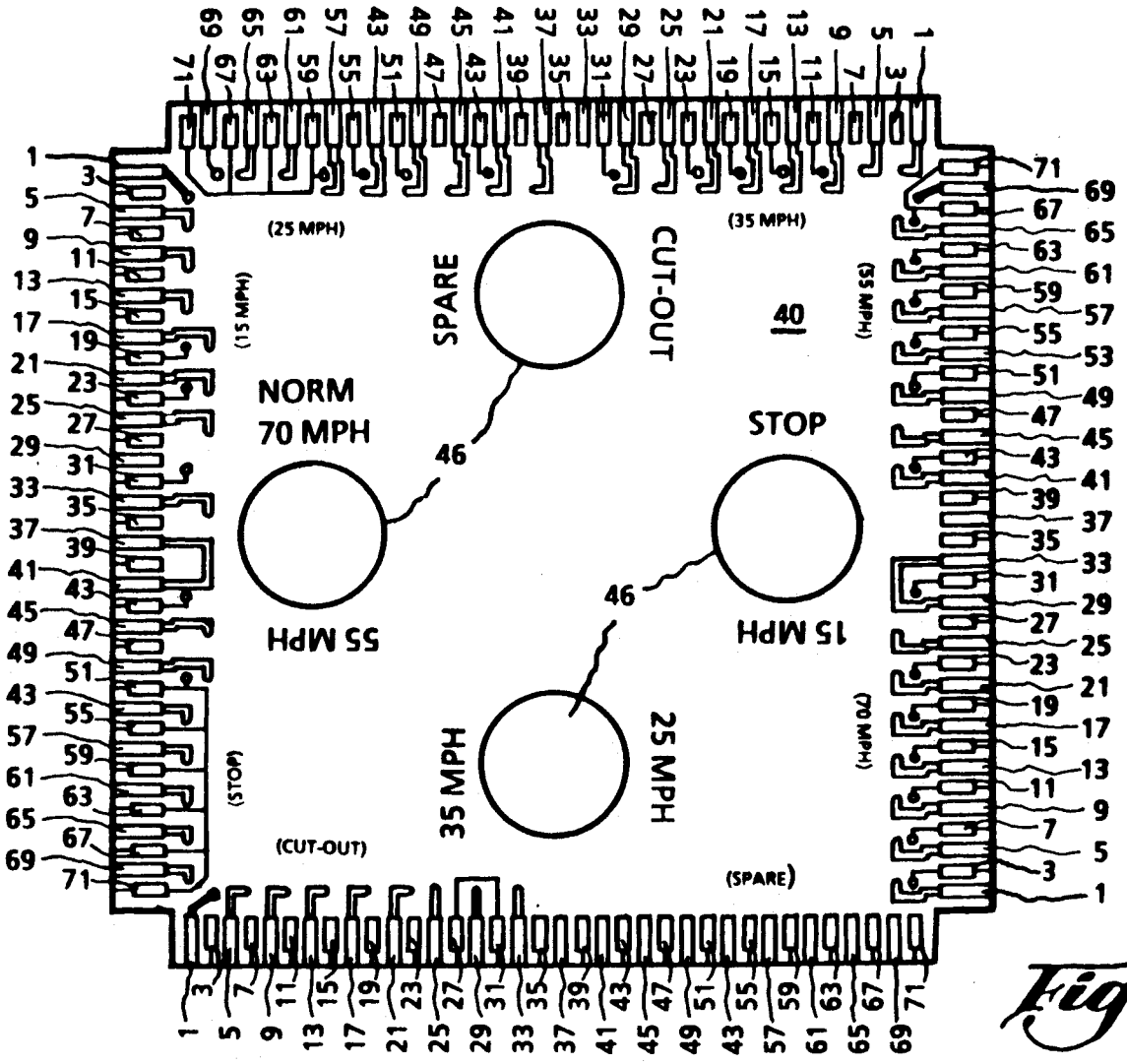
Figure 12:
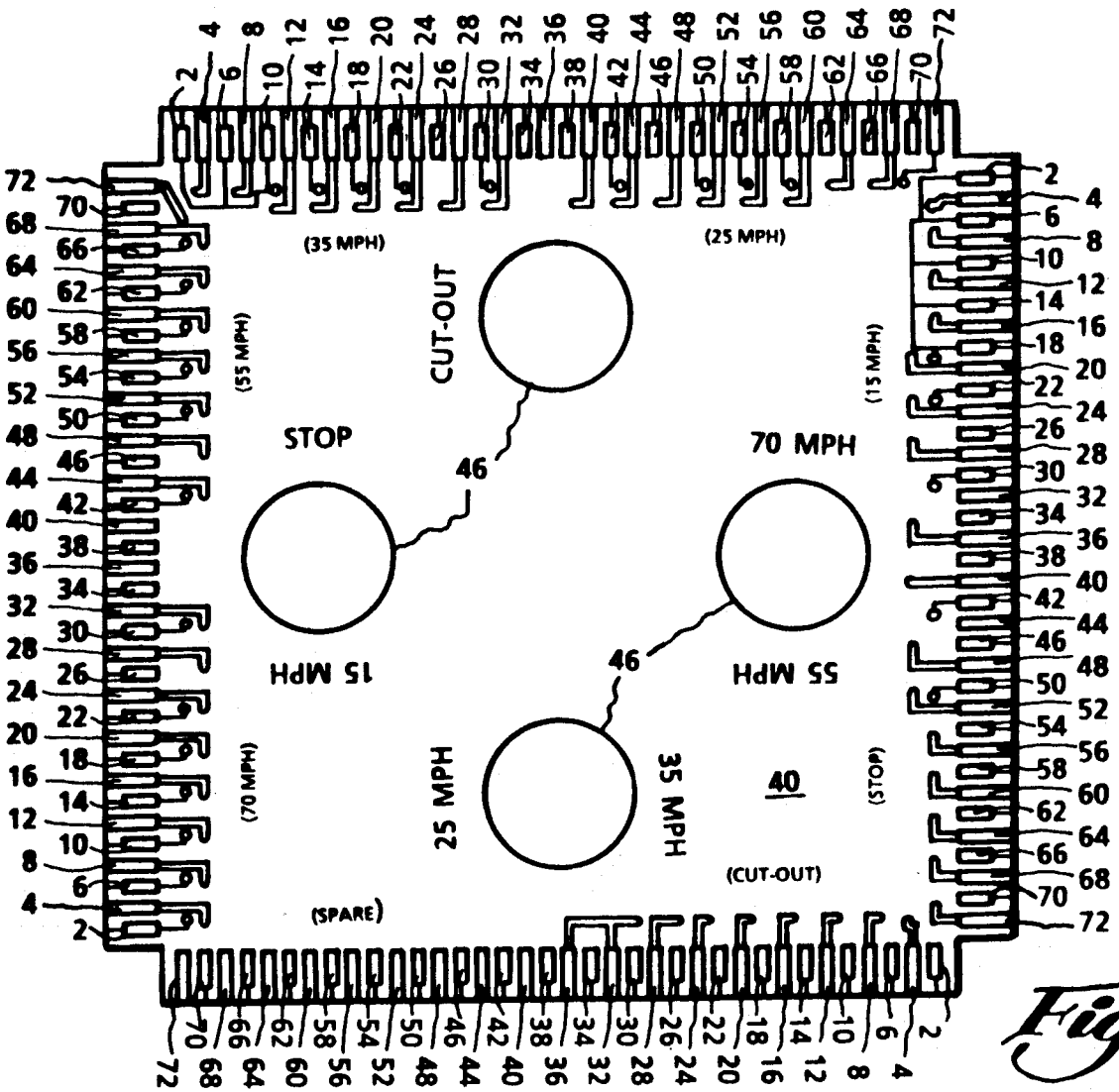

FIG. 3*a*–3*c* constitute a schematic diagram of a speed restricted train speed control system in accordance with the present invention;

FIG. 4 is a schematic diagram showing the arrangement of contact sets in the edge connector of the speed restriction carrier board of the system shown in FIG. 3;

FIG. 5 shows the arrangement of the sets of contacts located at the edges of the selector board which provide different allowable speeds (speed restriction) when received in the edge connector on the carrier board shown in FIGS. 3 and 4;

FIG. 6 is a table illustrating the colors of the light emitting elements of the indicator illustrated in FIG. 4 which correspond to different speed restriction conditions for the example being illustrated;

FIG. 7 is a more detailed schematic diagram of the indicator shown in FIG. 4;

FIG. 8 is an exploded view illustrating the speed restriction selection board, the carrier board, and the mother board of the system illustrated in FIG. 3;

FIGS. 9 and 10 are, respectively, front and back side elevations of the carrier board; and FIGS. 11 and 12 are, respectively, front and back side elevations of the selector board.

Figure 1:
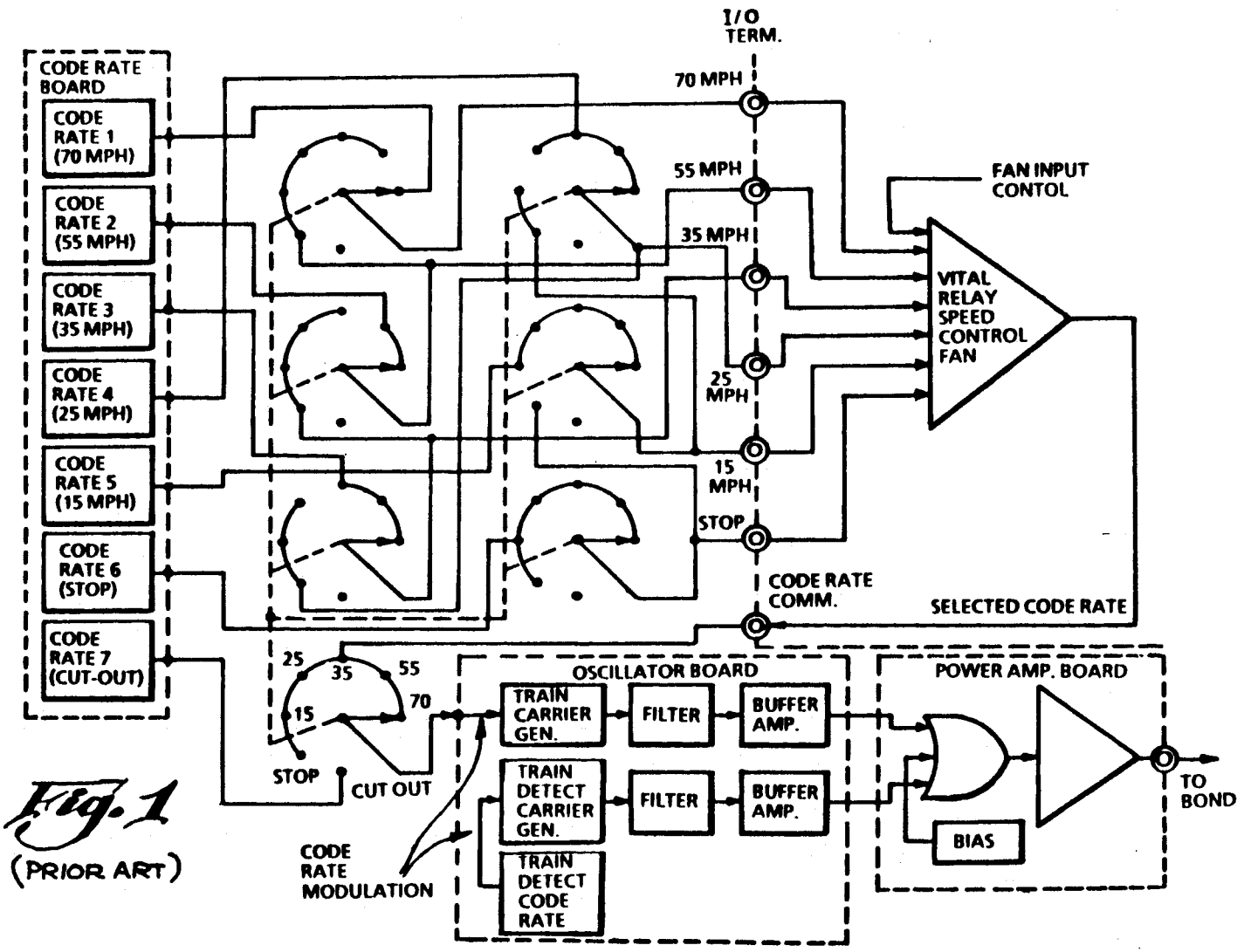
Fig. 1 (PRIOR ART)
FIG. 1 is a schematic diagram of a speed restricted train speed control system in accordance with the prior art.

Referring to FIG. 1, there is shown a speed control system of the prior art. This system uses a series of code rate generators which operate at different frequencies and provide code rates (rates 1 through 7 in the Figure) on different outputs through a speed restriction panel to a vital relay speed control fan which selects one of the code rates in accordance with control inputs from a train speed control system (TSCS). The selected code rate line extends back through the panel to an output which modulates a train speed carrier generator on an oscillator board. There are two oscillators on the board, the outputs of which are combined and amplified in a power amplifier, which provides one carrier modulated at the selected code rate, which is applied to the bond of the track section where the speed of the trains is to be controlled and another modulated carrier for the detection of trains. The code rate generators are shown on a code rate board. The oscillators and the power amplifier are shown being disposed on their respective boards.

The oscillator board contains two audio frequency carrier generators, one being the Train Speed carrier generator and the second being the Train Detect carrier generator. The Train Speed carrier generator is modulated by the selected speed code rate signal, is filtered and amplified on one f the Buffer amplifiers. The Train Detect carrier generator (different frequency) is modulated by one of two train detect code rates (different from any of the speed code rates), is filtered and is amplified by a second buffer amplifier. The required level of the two signals is adjusted in their respective buffer amplifiers. The power amplifier combines the two non-interfering code rate signals amplifies them and applies them, for example, through an output coupling transformer to the track impedance bond. Discussions of bonds and couplings may be found by reference to the above reference U.S. patents, and also C. S. Wilcox U.S. Pat. No. 3,927,851 issued Dec. 23, 1975.

The speed restriction apparatus of the system illustrated in FIG. 1 is found on the speed restriction panel. There multi-deck ganged rotary switch is used, one switch deck to handle each code rate. Each rotary switch circuit is on a separate deck which does not provide for vital operation since the distance between contacts on the rotary switches is typically less than the minimum one-quarter inch "creepage" distance between bare circuit elements which is required by specifications for vital circuits. Failure modes are also engendered by possible relative movement between the rotary switch decks. The ganged operation of all switch decks is provided by a "D" shaped shaft which extends through the switch decks and keys them for synchronization. Synchronization is lost if the D-shaped hole in a switch deck becomes round or otherwise out of shape. This defeats vital operation and may cause unsafe circuit arrangements. Also, to accommodate to the different speed restriction systems used by different Transit Authorities, different wiring of the multi-deck switch is required.

Figure 2:
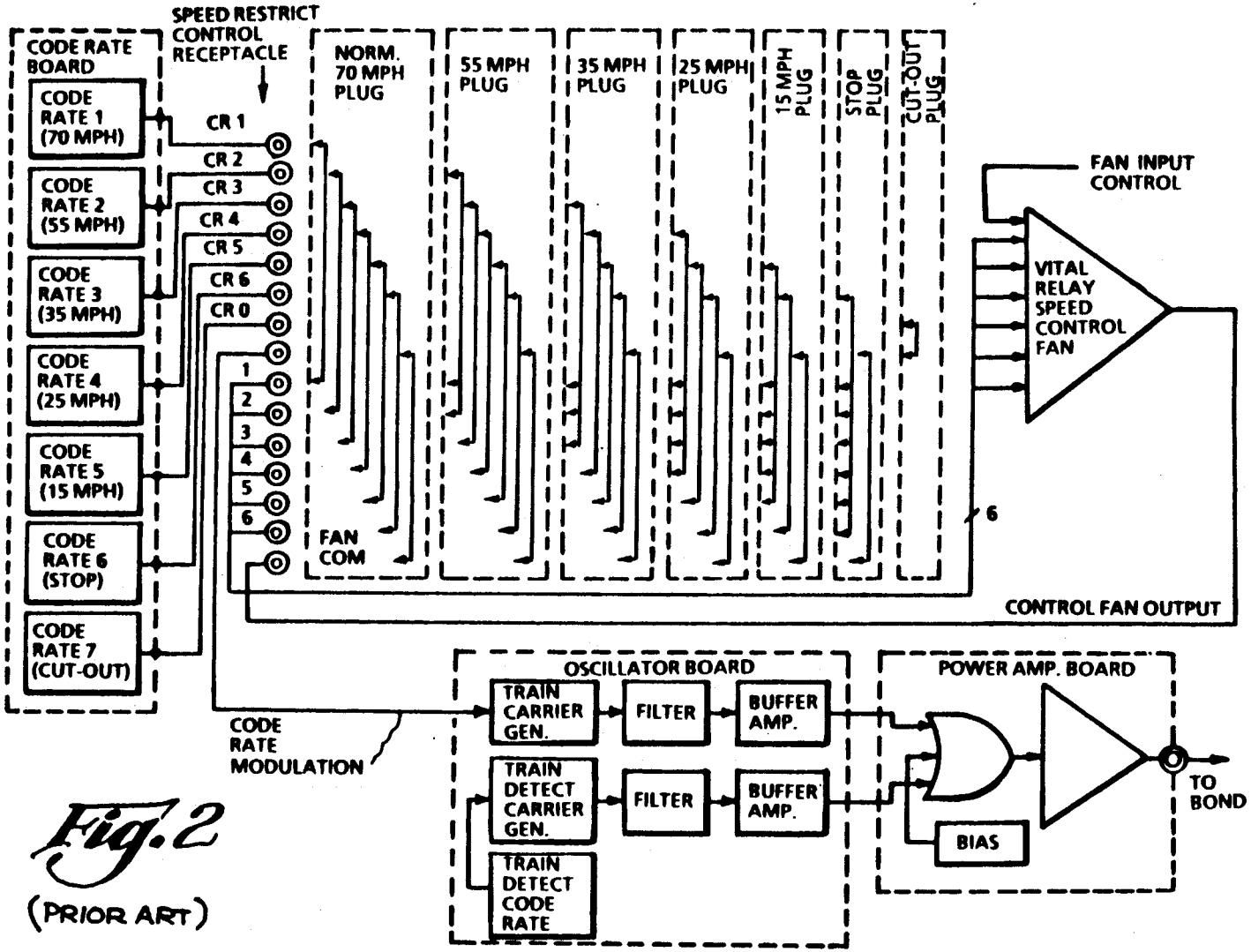
Fig. 2 (PRIOR ART)
FIG. 2 is a schematic diagram of another speed restricted train speed control system in accordance with the prior art.

In the prior art system shown in FIG. 2, the code rate board, vital relay speed control fan, oscillator board and power amplifier board are the same as shown in FIG. 1. The speed restriction apparatus is provided by a receptacle having connections to the different code rate generators on the code rate board and output connections to the speed control fan and between the output of the speed control fan (control fan output) and a common input (selected code rate) to the oscillator board. Individually wired plugs are plugged into the receptacle. In the illustrated design, there are seven possible different speed restriction options. There are, therefore, seven differently wired speed restriction plugs. Different wiring of the receptacle and the plugs is necessary depending upon the complement of code rate (speed control) signals which is used by the railroad authority in implementing their train speed control system. While the scheme of FIG. 2 does not have all the unsafe failure modes of the multi-deck rotary switch shown in FIG. 1, with FIG. 2, there is no built-in practical storage facility for the individual speed restriction plugs, and there is the possibility of misplacing a needed plug at a critical time.

Referring to FIG. 3A & 3B, there is shown a speed control system also having a vital relay speed control fan 30 and a code rate generator board 32 which provides a source of up to nine different code rate signals. Only seven signals are used in the herein-illustrated system. However, there are provisions for nine which can readily be incorporated or substituted, thereby enabling the system to handle different complements of code rates. The complement of code rates is selected by jumpers J1 through J7 on the speed restriction carrier board 34 of the restriction apparatus. This carrier board has connector means which provides a set of edge connections shown as the P 3 card edge connector in FIG. 4. The carrier board has wiring which allows it to handle, in a vital manner, all of the vital speed control (code rate) signals which are generated by the code rate source on the board 32 and provided to the speed control fan 30 and also as the train code rate (selected code rate) to an oscillator board 36 of the system. The oscillator board is connected to a power amplifier board 38. The power amplifier board provides the amplified control output signal to the bond of the track section where the train speed is to be controlled.

The restriction apparatus operates with a speed restriction selector board which has eight sets of contacts on opposite sides of a square double-sided printed circuit board 40, as shown in FIGS. 8, 11 and 12. Two sets of contacts are located along each side and each set, if present (a spare set does not use any connections between the contacts thereof), thereby providing seven different maximum allowable speed selections from normal (70 MPH) through stop and also cut out, for the example being illustrated. It should be noted that connections from one side of the board to the other side of the board are made through plate-through holes.

The speed restriction carrier board 34 is shown in FIGS. 8, 9 and 10 has a slot with guides along side edges of the slot and contacts along the bottom edge of the slot 42. These contacts are connected to an edge connector (not shown in FIGS. 9 and 10 but shown in FIG. 8 as being disposed over the contacts along the bottom edge of the slot 42). The slot and edge connector of the carrier board forms a receptacle for the speed restriction selection board 40. The speed restriction selection board has holes 46 in which the operator's fingers can be inserted to facilitate removal of the board so that it can be revolved or flipped over to select the maximum desired speed.

The selection board has contacts shown as fingers which are numbered 1 through 72, with even-numbered contacts on one side of the board and odd-numbered contacts on the other side of the board. The bottom edge of the speed restriction carrier board slot also has connectors which are numbered from 1 through 72 again with even contact fingers on one side and odd on the opposite side of the carrier board. Only one-half of these contacts (odd contacts 1 to 35 and even contacts 2 to 36) are utilized to provide the contact set to which connections are made to the contacts on the selector board. These contacts are numbered correspondingly in FIG. 9 and 10 and are indicated as the contacts of P 3 card edge connector. As noted above, the selection board has printed circuit contact fingers on all four edges of the board. There are two separate sets of contacts per edge making a total of eight contact sets available. Each of these contact sets corresponds to a different maximum allowed speed. The allowed speeds for the illustrated embodiment are labelled on the top of each connector set shown in FIG. 5.

For the P 3 card edge connectors, contact fingers 1 through 36 make up one switching circuit and in the reverse order contact fingers 72 down through 37 make up the other switching circuit on the same edge.

As a result, the single speed restriction selection board 40 can be plugged into the receptacle of the carrier board 34 in any one of eight ways, effecting any one of eight different speed restriction selections. The selection board can be plugged in along any of its four edges and it can be turned upside down and plugged in again along any of its four edges in an upside down (flipped over) aspect.

The speed restriction carrier board mechanical design is like the code rate board, oscillator board and power amplifier board to be mounted on a mother board 48 (FIG. 8) which provides the connections therebetween as shown in FIG. 3.

Returning to the selection board 40, it will be observed, as shown in FIGS. 11 and 12, that the board is printed with the speed restrictions which are operative above one of the holes 46 at the edge which is located at the front (to the left and along the outer edge 52 of the carrier board 34). The speed corresponding to the contact set along each edge of the selection board is also printed immediately adjacent to that contact set.

FIG. 4 also shows the contacts of the P 3 edge connector (odd contacts 1 through 35) being brought out to the P 2 mother board connector so as to be connected to the output of the code rate generators which are brought along lines on the mother board from the code rate board to the carrier board (see FIG. 3). There is also shown a P1 output connector, which handles all the I/O connections to such system elements as the speed control fan and connections to other printed circuit boards. The P1 connector on all the printed circuit boards, provide I/O connections and also the customizing connections between the printed circuit boards, in order to accommodate the different requirements of different Transit Authorities, which cannot be included in the generic fixed printed circuit wiring of the mother board.

It will be seen from FIG. 5 that various combinations of connections are made between the input connections carrying the code rate vital signals and the output connections carrying these vital signals to the fan. In normal operation the connections are straight through. Then the 70 MPH code rate signal goes directly from finger contact 3 in the group of contacts on one side of the carrier board edge connector to finger contact 2 on the opposite side of the carrier edge connector. If a 55 MPH speed restriction is imposed, then the 55 MPH contact set is selected using the selector board, it will be seen that a connection coming in on the 70 MPH input (contact 70) is not used. A code rate signal coming in on the 55 MPH contact 66 is connected by a conductive path between contacts 67 and 71 in the group on the left side of the contact set for 55 MPH. The 55 MPH code rate signal is the outputted on the 70 MPH line to the fan. Thus, if 70 MPH is selected by the control inputs from the TSCS, a 55 MPH code rate will be outputted as the speed control code rate. The same is true for all of the other code rates. Different arrangements of connections through the double sided printed circuit selection board provide the restriction of allowable speed by utilizing only allowed code rates corresponding to the contact set which is in engagement with contacts of the carrier board.

FIG. 5 shows the interconnections for the different speeds. The "cut-out" selection shows that no "cut-out" code rate (CR #7) is transmitted to the train. There are no connections between the contacts when it is in the spare location.

In order to provide protection between the circuits which carry the vital code rate signals, alternate contacts on opposite sides of the carrier board (contacts 4–5, 8–9, 12–13, etc.) are interconnected as shown by the dashed lines therebetween. Also, alternate contacts on opposite sides of the selector board which engage and connect to these interconnected alternate contacts of the carrier edge connector are interconnected by conductive paths through the selection board. For example, there is a connection between contacts 1 and 4, 5 and 8, 9 and 12, etc. The connections on the carrier board and the paths between the alternate contacts of the selection board provide a ground or common circuit interlaced or threaded between every vital signal circuit line which passes through the contact sets of the carrier board and of the selection board. Since ¼ in. vital spacing cannot be achieved between vital circuit paths on the speed restriction carrier and selection boards at the P3 connector, the above-described "ground" interlace circuit provides a barrier to unsafe shorting between vital circuit paths. In order to check for the validity and integrity of this protective interlace circuit, this circuit provides the ground or common return on mother board circuit trace 80 to the common or ground input terminal on the Code Rate board 32. Therefore, if the interlace circuit should open up or become disconnected from "ground" and cannot perform the protection function anymore, the output from the code rate board will cease, because of the loss of its ground or common return, thus creating a "stop" signal for the train.

An additional feature as shown in FIGS. 4, 7, 9 and 10, is a light emitting indicator 60 provided by red, yellow and green light emitting devices or diodes (LEDs). FIG. 7 particularly illustrates the fail-safe design technique used to ensure that the indicator control leads can perform the protective means between vital circuit paths, similar to the "ground" interlace circuit.

The control lines of the indicator circuit are provided by connections through the contacts of the speed restriction carrier board edge connector and of the selection board. These are contacts 29, 32, 33 and 36 of the carrier board edge connector and corresponding contacts of the selector board (the last three contacts on each side of the board as shown in FIG. 5). The control lines serve as ground protection circuits between the lower three vital signal circuits because they are vitally maintained at low voltage as accomplished by using film resistors for R3 through R7, shown in FIG. 7. Film resistors do not reduce in resistance under any failure mode. Resistor R1 is a special vital wire-wound resistor which does not increase in resistance value under any failure mode and has lead construction who's integrity is guaranteed by manufacture, continual quality monitoring and by special handling, to not break or become detached from the resistive element. Furthermore, this resistor is mounted in a special 4-terminal connection arrangement as shown in FIG. 7. With this 4-terminal connection, if the lead between R1 and the film resistors opens or the lead between R1 and resistor R9 opens, the indicator control leads between the vital circuits will be pulled down to ground, thus still providing the vital protective function. If the ground connection between R1 and the carrier common terminal connection opens or the connection between R1 and LED CR5 opens, the indicator control leads will rise to the power supply potential, which would be unsafe, but both of these leads are in series with the protective ground interlace circuit and the code rate board would lose its ground or common return connection which would cause the output of the code rate board to cease which in turn would create a "stop" signal for the train. Therefore, fail-safety is still preserved.

It is apparent that different combinations of lighting of the red, yellow and green LED's (CR1, CR2 and CR3) can be selected by shorting out indicators which are not to be lighted. The selective shorting of the LED's is done by jumper connections on the speed restriction selection board 40. The table in FIG. 6 illustrates the indication color combinations vs. speed restriction, thus indicating to the maintainer if a speed restriction is in effect and if it is in effect, what level of speed restriction it is.

From the foregoing description, it will be apparent that there has been provided improved speed restriction control apparatus for a train speed control system. Variations and modifications of the herein-described system will undoubtedly suggest themselves to those skilled in the art. For example, instead of using a code rate signal source where the code rate signals are continually generated and selected with a vital relay speed control fan, the speed control system may be used to select or energize selected code rate generators. Then, the restriction apparatus is used to provide an interface between the control lines from the TBCS to the control rate signal sources and similarly establishes a maximum allowed code rate corresponding to a maximum allowed speed. Other variations and modifications of the herein-described system in accordance with the invention will undoubtedly suggest themselves to those skilled in the art. Accordingly, the foregoing description should be taken as illustrative and not in a limiting sense.

We claim:

1. In a railroad train speed control system having a source providing a plurality of control signals concerning allowable train speeds over a section of track, an improved apparatus for restricting the injection of said control signals corresponding to allowed train speeds above a certain speed said apparatus comprising means responsive to said control signals for generating signals for injection into said tracks and said apparatus having a first member having a first set of contacts, a plurality of contacts in said first set being connected to said source and at least one contact in said first set being connected to said generating and injection means, said apparatus having a second member having a plurality of sets of second contacts each in a different position on said second member, different ones of said second sets of contracts being engagable with said first set of contacts to provide different connections between the contacts of said first set for restricting the application of control signals above different allowed speeds to said injection means when said second member is received by said first member in different ones of said positions to provide engagement between said first contacts and different ones of said plurality of second sets of contacts.

2. The improvement according to claim 1 wherein said first and second sets of contacts are in rows, first conductive paths between alternate pairs of said contacts of said first set of contacts, said second sets of contacts also being in rows and having alternate pairs of contacts which are engagable with said alternate pairs of contacts of said first set when said second member is received by said first member in different ones of the positional relationships thereof, means providing second conductive paths between said alternate pairs of contacts of each of said second sets, contacts of said first set between said alternate pairs of contacts of said first set being connected to said source and contacts of said second sets between said alternate pairs of contacts of said second sets being engagable with said contacts of said first set which are connected to said source, said alternate pairs of contacts of said first set and said seconds sets and said first and second conductive paths therebetween being disposed between said contacts of said first set which are connected to said source and to said injection means and the contacts of said second set which engage the contacts of said first set which are connected to aid source and to said injection means, and means for maintaining said alternate pairs of contacts of said first and second sets and connections there between at a lower potential than said signals carried by said connector means between said source and said injection means.

3. The improvement according to claim 2 wherein said first and second conductive paths and said alternate pairs of contacts of said first and second sets define a circuit interlaced between said contacts of said first and second sets which are connected to said source and to said injection means.

4. The improvement according to claim 3 wherein said interlace circuit is a series circuit.

5. The improvement according to claim 4 wherein said series circuit is connected to a point of ground or common potential.

6. The improvement according to claim 5 further comprising means including said interlaced circuit for inhibiting the generation of said speed control signals if the said interlaced circuit becomes disconnected from ground.

7. The improvement according to claim 6 wherein said inhibiting means includes means for preventing the generation of said speed control signals if said interlaced circuit presents an open circuit.

8. The improvement according to claim 1 further comprising indicator means for indicating the speed restriction corresponding to the positional relationship of said second member when received in said first member, said indicator means including a plurality of contacts of said first set and of said second sets which define different connections depending upon the positional relationship of said first member with respect to said second member.

9. The improvement according to claim 1 wherein said first member is a printed circuit board having a connector defining said first set of contacts on opposite sides thereof, said contacts being in proximity with an edge of said board providing said first member, said second member is another printed circuit board having opposite sides and a plurality of edges, said second sets of contacts being disposed along said opposite sides and extending to said edges, and means on said first board member for receiving and capturing said second board member in any of said plurality of positional relationships with said first and second sets of contacts in engagement with each other.

10. The improvement according to claim 9 wherein said first board member has a slot with sides and an end, said end of said slot defining said edge of said first board member in the proximity of which said first set of contacts is disposed, said means for capturing said second board member being disposed along said slot so that said second board member is receivable in said slot in any of said positional relationships.

11. The improvement according to claim 9 wherein said second board member has different arrangements of connections between said contacts on opposite sides thereof which are connected said source, each arrangement corresponding to a different allowed speed restriction.

12. The improvement according to claim 11 wherein said first set of contacts is disposed along a portion of said edge of said board member and a plurality of said second sets of contacts are disposed along at least one edge of said second board member in a portion thereof corresponding to said portion of said edge of said first member such that said first set of contacts is engaged with different ones of said plurality of second sets of contacts along said one edge of said second member depending upon the relationship of the sides of said second member with respect to the sides of said first member whereby a different speed restriction may be selected by removing, flipping over and replacing said second member into contact engaging relationship with said first member.

13. The improvement according to claim 1 wherein said source provides a plurality of outputs each corresponding to a different one of said speeds, said generating and injection means includes means operative to receive said outputs and selecting one of said outputs depending upon train operating conditions, and means for translating said selected speed control signal into an output for injection into said tracks, said first set of contacts including the first group of contacts connected to said source to receive different ones of said speed control signals and a second group of contacts connected to said selecting means, said second sets of contacts each having first and second groups of contacts engagable and making connections with said first and second groups of contacts of said set of contacts, each of said second sets of contacts having a different arrangement of connections between the first and second groups of contacts thereof for distributing control signals from said first group of said first set of contacts to different combinations of said second group of said first set of contacts in accordance with the speeds in which trains are allowed to travel in said track section.

14. The improvement according to claim 13 wherein aid first member is a printed circuit board having said first and second groups of contacts on opposite sides thereof, and said second member is a printed circuit board having said plurality of second sets of contacts, each of said second sets having each group of contacts thereof on an opposite side of said second board and extending to an edge of said board, and connector means on said first and second boards for attaching said second board to said first board with said contact sets thereof connected to each other to provide said different combinations of connections.

15. The improvement according to claim 14 wherein said first board has a square slot therein having sides and an edge at one end and said second board is square and has edges, each of said edges having a pair of said second sets of contacts extending to said edge, said edge at said end of said slot having said first set of contacts arranged along approximately one half of the length thereof whereby any of eight sets of said second contacts are positionable with respect to said first set of contacts when said second board is located in said slot.

16. The improvement according to claim 13 further comprising a plurality of indicator lamps on said first board member, connections between said lamps and a plurality of said first set of contacts, and means for passing current through said plurality of first set of contacts via a plurality of contacts in each of said second sets of contacts for illuminating different combinations of said lamps which correspond to said combinations of connections provided by said second board member and representing different speed restrictions.

17. The improvement according to claim 13 further comprising a mother board, a further board containing circuits providing said source of different speed control signals, at least one still further circuit providing said means for providing outputs for injection into said tracks in response to said selected speed control signal, said first board, said further board and said still further board being mounted on said mother board, said mother board providing connections between said boards.

18. The improvement according to claim 13 wherein contacts disposed alternately in said first and second groups of said first set of contacts are interconnected and contacts which are disposed alternately in said first and second groups of said second sets of contacts are interconnected to define a circuit, interlaced between contacts of said first and second group connected to said source and to said selection means and contacts of said first and second groups of said second sets of contacts, which provide connections for said speed control signals, means connecting one end of said circuit to a reference potential and the other end of said interlaced circuit to said source for enabling the operation of said source to provide said speed control signals when said interlaced circuit is a closed circuit and inhibiting the operation of said sources when said interlaced circuit is an open circuit.

19. The improvement according to claim 18 wherein said contacts providing said interlaced circuit of said first set of contacts make contact with said contacts of said second set of contacts which provide said interlaced circuit prior to contact being made between other contacts of said first and second sets.

* * * * *